US007147196B2

(12) United States Patent
Knight et al.

(10) Patent No.: US 7,147,196 B2
(45) Date of Patent: Dec. 12, 2006

(54) DEVICES AND METHOD FOR HANGING A DISPLAY BOARD

(75) Inventors: Colin Knight, Skokie, IL (US); Tom Dunlap, Skokie, IL (US)

(73) Assignee: General Binding Corporation, Northbrook, IL (US)

( * ) Notice: Subject to any disclaimer, the term of this patent is extended or adjusted under 35 U.S.C. 154(b) by 0 days.

(21) Appl. No.: 10/409,878

(22) Filed: Apr. 9, 2003

(65) Prior Publication Data

US 2003/0201376 A1 Oct. 30, 2003

Related U.S. Application Data

(60) Provisional application No. 60/376,305, filed on Apr. 29, 2002.

(51) Int. Cl.
*A47G 1/16* (2006.01)

(52) U.S. Cl. ..... 248/490; 248/476; 248/489; 40/746; 40/757; 40/759; 40/761

(58) Field of Classification Search ..... 248/489, 248/490, 495, 494, 476, 488, 466; 40/757, 40/758, 759, 761, 745, 746, 713, 790
See application file for complete search history.

(56) References Cited

U.S. PATENT DOCUMENTS 1,944,203 A * 1/1934 Wittig ..... 248/494
3,363,871 A 1/1968 Slazik et al.
3,541,714 A * 11/1970 Bruck, Jr. ..... 40/791
3,955,790 A * 5/1976 Ballin ..... 248/489
4,217,710 A * 8/1980 Becker ..... 40/792
4,239,170 A 12/1980 Planebo
4,282,668 A * 8/1981 Jolkovski ..... 40/790

(Continued)

FOREIGN PATENT DOCUMENTS

JP 9191951 7/1997

OTHER PUBLICATIONS

Printed website pages from http://www.thejournal.com/magazine/vault/A3346.cfm, printed Jul. 23, 2003.

(Continued)

*Primary Examiner*—Amy J. Sterling
(74) *Attorney, Agent, or Firm*—Michael Best & Friedrich

(57) ABSTRACT

Devices for hanging a display board frame wherein a first bracket is mounted on a wall and has a hook on one end supportingly engaging a channel on a corresponding first edge of a display board frame and a second cooperating bracket having a slotted portion is slidingly mounted on the wall in a position corresponding to a second edge of the display board frame spaced apart and opposed to the first display board edge and the second bracket has a hook on its end in alignment with a channel on the second edge of the display board frame; and the display board is releasably secured on the wall when the upper bracket is slid against the display board frame until its hook engages the channel on the second edge of the display board frame, The invention also includes a method for hanging a display board frame including the steps of securing the first bracket on the wall with its hook engaging the channel on one edge of the frame, securing the second slotted bracket on the wall with its hook spaced away from the second edge of the frame, and sliding the second bracket against the channel on the second edge of the frame to secure the frame on the wall.

12 Claims, 3 Drawing Sheets

U.S. PATENT DOCUMENTS

| | | | | | |
|---|---|---|---|---|---|
| 4,340,199 | A | * | 7/1982 | Brock | 248/544 |
| 4,364,537 | A | * | 12/1982 | Helzer | 248/448 |
| 4,368,585 | A | * | 1/1983 | Meltzer et al. | 40/790 |
| 4,403,761 | A | | 9/1983 | Jamar | |
| D274,037 | S | | 5/1984 | Crim et al. | |
| 4,456,286 | A | | 6/1984 | Jamar | |
| 4,458,872 | A | * | 7/1984 | Couch | 248/497 |
| 4,863,136 | A | * | 9/1989 | Sanders | 248/490 |
| D315,093 | S | | 3/1991 | Hanna | |
| 5,035,626 | A | | 7/1991 | Persing | |
| 5,038,539 | A | | 8/1991 | Kelley et al. | |
| D322,993 | S | | 1/1992 | Hobson | |
| 5,190,156 | A | | 3/1993 | Conaway et al. | |
| 5,211,365 | A | | 5/1993 | Melzian | |
| D336,730 | S | | 6/1993 | Hofman | |
| D337,619 | S | | 7/1993 | Evenson | |
| 5,295,594 | A | | 3/1994 | Melzian et al. | |
| 5,295,651 | A | * | 3/1994 | Baker, Jr. | 248/488 |
| 5,301,477 | A | | 4/1994 | Rellinger et al. | |
| 5,342,014 | A | * | 8/1994 | Wilson | 248/476 |
| 5,344,030 | A | | 9/1994 | Evenson | |
| 5,433,414 | A | * | 7/1995 | Vieira | 248/316.4 |
| D364,553 | S | * | 11/1995 | Wilson | D8/373 |
| 5,478,040 | A | | 12/1995 | Rellinger et al. | |
| 5,511,348 | A | | 4/1996 | Cornell et al. | |
| 5,524,370 | A | * | 6/1996 | Roy | 40/748 |
| D381,688 | S | | 7/1997 | Green et al. | |
| 5,704,147 | A | | 1/1998 | Rellinger | |
| 5,743,414 | A | | 4/1998 | Baudino | |
| 5,768,840 | A | | 6/1998 | Feldpausch et al. | |
| 5,775,521 | A | | 7/1998 | Tisbo | |
| D404,208 | S | | 1/1999 | Beno | |
| 5,881,909 | A | | 3/1999 | Crain et al. | |
| D408,179 | S | | 4/1999 | Rellinger | |
| 5,906,079 | A | | 5/1999 | Brickner et al. | |
| 5,980,809 | A | | 11/1999 | Crain et al. | |
| 6,055,755 | A | | 5/2000 | Prokes | |
| 6,073,399 | A | | 6/2000 | Shipman et al. | |
| 6,139,331 | A | | 10/2000 | Owen | |
| D435,593 | S | | 12/2000 | Hellwig et al. | |
| D439,444 | S | | 3/2001 | Berger et al. | |
| 6,202,974 | B1 | | 3/2001 | Rellinger | |
| 6,212,810 | B1 | | 4/2001 | Jones | |
| 6,263,602 | B1 | | 7/2001 | Seiber et al. | |
| 6,272,779 | B1 | | 8/2001 | Seiber et al. | |
| 6,279,761 | B1 | | 8/2001 | Niewiadomski et al. | |
| D449,340 | S | | 10/2001 | Beno | |
| D450,348 | S | | 11/2001 | Beno | |
| 6,328,571 | B1 | | 12/2001 | Dricken et al. | |
| 6,374,547 | B1 | | 4/2002 | Baloga et al. | |
| D459,756 | S | | 7/2002 | Lio et al. | |
| D462,992 | S | | 9/2002 | Beno | |
| D463,493 | S | | 9/2002 | Beno | |
| 6,446,396 | B1 | | 9/2002 | Maragoni et al. | |
| 6,449,909 | B1 | | 9/2002 | Baloga et al. | |
| 6,453,518 | B1 | | 9/2002 | Adams et al. | |
| 6,463,701 | B1 | | 10/2002 | Baloga et al. | |
| 6,540,094 | B1 | | 4/2003 | Baloga et al. | |
| 6,568,335 | B1 | | 5/2003 | Hamilton et al. | |
| D475,407 | S | | 6/2003 | Beno | |
| D475,409 | S | | 6/2003 | Beno | |
| 6,575,758 | B1 | | 6/2003 | Hastings | |
| 6,588,134 | B1 | | 7/2003 | Perelli | |
| 6,612,077 | B1 | | 9/2003 | Parshad | |
| 6,625,935 | B1 | | 9/2003 | King et al. | |
| 6,634,127 | B1 | * | 10/2003 | Bauer | 40/792 |
| 6,647,652 | B1 | | 11/2003 | Seiber et al. | |
| 6,681,529 | B1 | | 1/2004 | Baloga et al. | |
| 6,748,710 | B1 | | 6/2004 | Gresham et al. | |
| 2002/0095840 | A1 | | 7/2002 | Seiber et al. | |
| 2002/0124426 | A1 | * | 9/2002 | Dewberry | 33/494 |
| 2002/0124478 | A1 | | 9/2002 | Rush et al. | |
| 2002/0189171 | A1 | | 12/2002 | Parshad | |
| 2003/0005654 | A1 | | 1/2003 | Weber et al. | |
| 2003/0051415 | A1 | | 3/2003 | Remelts | |
| 2003/0126778 | A1 | | 7/2003 | Arko et al. | |
| 2003/0182871 | A1 | | 10/2003 | Gresham et al. | |
| 2003/0182885 | A1 | | 10/2003 | Gresham et al. | |
| 2003/0201376 | A1 | | 10/2003 | Knight et al. | |
| 2004/0091849 | A1 | | 5/2004 | Gallant et al. | |
| 2004/0148835 | A1 | | 8/2004 | Ives et al. | |

OTHER PUBLICATIONS

Printed website page from http://www.steelcase.com/servlet/ProductServlet?ACTION=4&CAT_ID=3&CAT_NAME=Worktools&TY..., printed Jul. 23, 2003.

Printed website page from http://www.steelcase.com/images/full/photos/99S1098HuddleboardOnConjunction.jpg, printed Jul. 23, 2003.

Printed website page from http://www.steelcase.com/images/full/photos/99S1147HuddleboardOnPosterRack.jpg, printed Jul. 23, 2003.

Printed website pages from http://www.bizedfurniture.com/wdeb34-gm-bf.html, printed May 28, 2003.

Printed website page from http://store5.yimg.com/I/bizedfurn_1742_14207692, printed May 28, 2003.

Printed website pages from http://www.knoll.com/products/product.jsp?prod_id=38, printed Jul. 23, 2003.

Printed website pages from http://www.allsteeloffice.com/getset, known as of May 28, 2003.

* cited by examiner

DEVICES AND METHOD FOR HANGING A DISPLAY BOARD

PRIORITY INFORMATION

This application claims benefit of priority from U.S. Provisional Patent Application Ser. No. 60/376,305, filed Apr. 29, 2002.

BACKGROUND AND SUMMARY OF THE INVENTION

This invention relates to hanging devices and a method for hanging a display board such as a bulletin board, easel or similar item, and is particularly directed to such hanging devices which comprises a one or more unique brackets for attachment to the upper margins of the reverse side of a the board and one or more unique brackets for attachment to the lower margins of the reverse side of a the board which selectively removably securely mounts the board on a wall in a manner where the mounting system is not visible from the face side of the board.

Usually, such a board is mounted to a wall from its face side in a manner where the mounting system is clearly visible. Such mounting systems may include ears or bracket on the frame or separate brackets for holding the board which are visible. Other mounting systems have employed hangers suspended from a picture rail or the like, but these mounting systems are usually visible and the mounting is not usually stable enough to permit a person using the board to mount indicia or write on it. Others have used mounting brackets on the reverse side of the frame, but usually such systems are cumbersome and visible from the face of the board. Hanging systems secured to the reverse side of the frame usually require careful calculations to make sure that the frame is mounted as intended, for example a hook may be mounted on the wall and a hook or wire may be mounted on the reverse side of the item being hung.

Sometimes the frame is placed in a public place where there is a danger that unauthorized persons will remove it from the wall, as for example where an art work is displayed for public view. In such situations, it may be desirable for authorized persons to remove the frame from the wall, but the ability of unauthorized persons to easily accomplish removal of the frame must be inhibited. It is also desirable to provide a hanging system where the mounting brackets are not anchored to the frame.

In the hanging devices embodying the present invention, the frame may be fabricated with a channel on its bottom and top peripheral edges. The lower edge frame position for elevating the easel above the floor is ascertained, and lower brackets for mounting the frame are attached to the wall in alignment with the bottom edge channel of the frame. These lower brackets have mounting holes for securing them flat to the wall and an upstanding flange extending from the bracket which may be fit into a channel on the bottom edge of the frame.

The frame bottom edge channel is then fit into the lower bracket flange and the easel is tilted against the wall so that the position of one or more upper brackets can be marked on the wall level with the upper edge of the frame. This upper bracket may be mounted flat on the wall in the location marked, and this bracket has an elongated upstanding slot and a flange on its upper edge extending from the bracket which may be fit into the channel on the top edge of the frame. This upper bracket flange is initially secure to the wall in a position above the channel on the top edge of the frame.

Preferably, the upper and lower brackets are vertically aligned. If more than one set of upper and lower brackets are used, the upper brackets should be horizontally aligned and the lower brackets should also be horizontally aligned.

Once the brackets are properly aligned on the wall, the frame is angularly attached to the lower bracket flange or flanges and tilted against the wall, covering the entire upper bracket except the flange portion of the upper bracket. When the frame or easel is properly arranged on the wall, as noted, the upper bracket flange is slid downwardly in the slot to mate with the frame or easel in the channel on the top edge of the frame. To remove the frame from the wall, the upper bracket flange is merely slid upwardly in the slot to the free the frame from the wall.

OBJECTS AND ADVANTAGES OF THE INVENTION

It is the object of the invention to provide mounting devices for a display board and a method for mounting such a board of the character recited.

Another object is to provide mounting devices which are not visible from the face of the board or frame and which are not permanently secured to the frame, but which permit easy mounting and removal of the frame from a wall without injuring the display board.

Another object is to provide mounting brackets which have securing surfaces for receiving a frame.

Another object is to provide mounting devices which provide stable removably secured mounting of a frame on a wall, permitting writing or hanging of indicia on the display board without affecting its mounting on the wall.

Another object is to provide a mounting system which permits exact alignment of a frame on a wall.

Another object is to provide mounting devices which are easy and inexpensive to manufacture and install and which are very efficient and easy to use.

These and other objects and advantages of the invention will become more apparent as this description proceeds, taken in conjunction with the accompanying drawings, in which like reference characters identify like parts of the structure.

DESCRIPTION OF A PREFERRED EMBODIMENT

Figure 4:
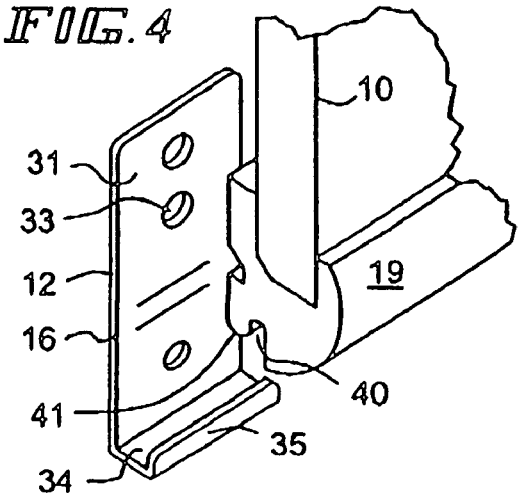
FIG. 4 is a perspective view showing a securement arrangement of a lower bracket in a lower channel of a frame.
Figure 5:
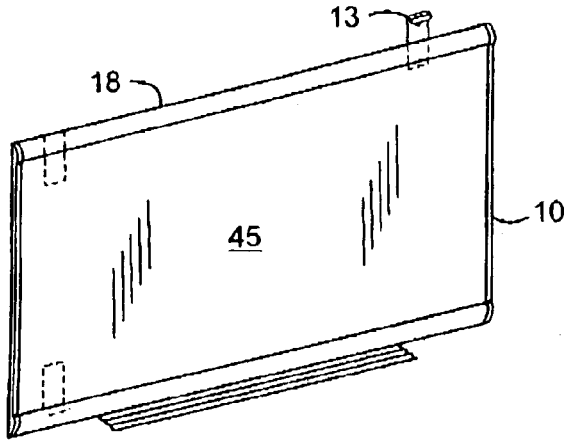
FIG. 5 is a perspective view of an easel mounted on a surface, showing the brackets in dotted lines, with one of the upper brackets secured in the frame and the other bracket arranged above the frame.

An display board or frame 10 is shown in FIG. 5 mounted on a wall 11 using the novel brackets 12 embodying the present invention. With reference particularly to FIGS. 1–4, these brackets 12 comprise one or more upper brackets 13 and one or more lower brackets 16, which are adapted to fit cooperating configured areas on the upper and lower edges, 18 and 19 of the frame 10.

Figure 1:
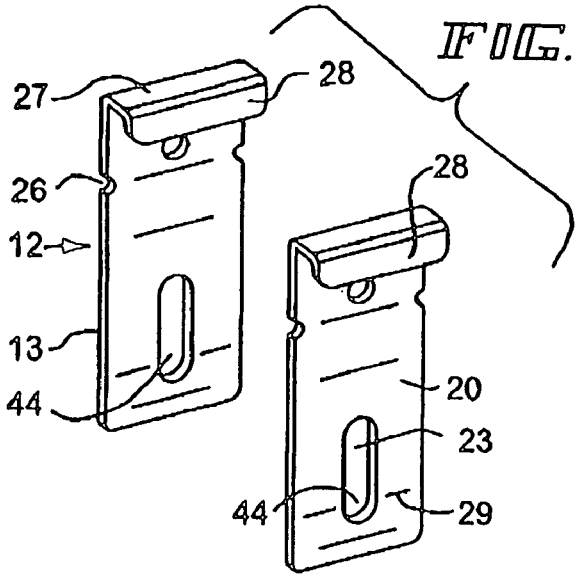
FIG. 1 is a perspective view of a pair of upper brackets embodying the invention.
Figure 3:
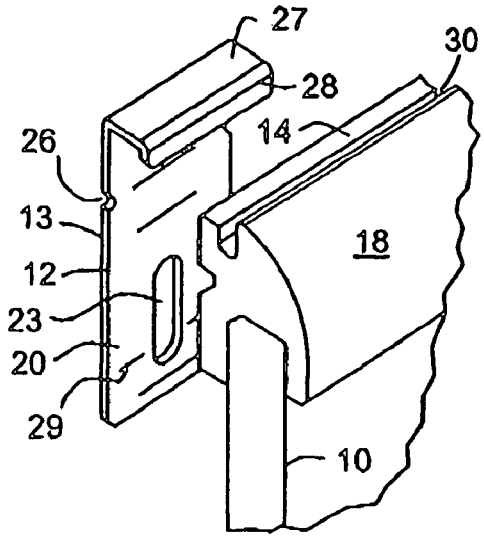
FIG. 3 is a perspective view showing a securement arrangement of an upper bracket in an upper channel of a display board or frame.

With reference to FIGS. 1 and 3, an upper bracket 13 comprises a generally flat plate 20 having an upstanding flange on its upper end and holes formed in the plate 20. A hole located in the bottom part of the plate 20 comprises an elongated slot 23, and the other hole near the top of the plate may comprises around aperture. Cooperating dimples or indentations 26 extend inwardly from the edges of each plate 20. The flange comprises a header 27 generally perpendicular to the plate 20 and a depending hook 28 extending downwardly from the header 27 and generally parallel to the plate 20. On each side of the plate 20 adjacent the lower end of the slot 23 there are aligned arrow indicia 29. These upper bracket parts described are also shown in FIG. 3, which also depicts a frame 10 having an upper edge 18 which has a channel 30 adapted to receive therein the header 27 and hook 28 of the upper bracket 13 when the frame is mounted on a wall as hereinafter described. Preferably the outside part 14 of the upper edge 18 of the frame has relief or a recess cut into it to accommodate the header 27 and hook 28 of the flange.

Figure 2:
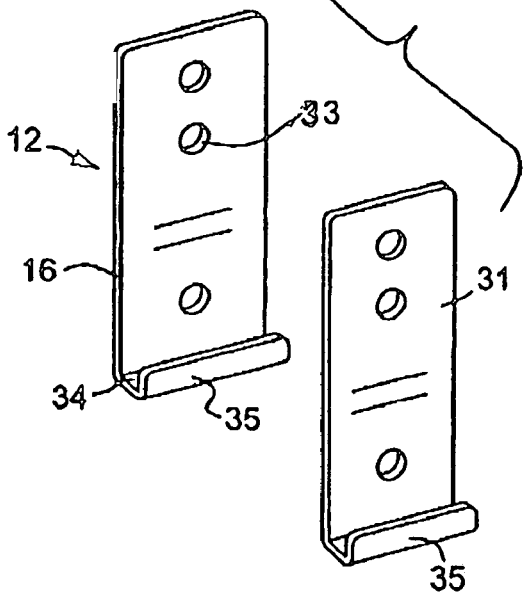
FIG. 2 is a perspective view of a pair of lower brackets embodying the invention.

With reference to FIGS. 2 and 4, a lower bracket 16 comprises a generally flat plate 31 having an upstanding flange on its lower end and mounting holes formed in the plate 31. Preferably these holes 33 may be used to for mounting this lower bracket to the wall 11. The flange comprises a base 34 generally perpendicular to the plate 31 and an upstanding hook 35 extending from the base and generally parallel to the plate 31. These lower bracket parts described are also shown in FIG. 4, which depicts a frame 10 having a lower edge 19 which has a channel 40 adapted to receive therein the base 34 and hook 35 of the lower bracket 16 when the frame is mounted on the wall as hereinafter described. Preferably outside part 41 of the lower edge 19 also has a relief cut into it to accommodate its related base 34 and hook 35.

Figure 6:
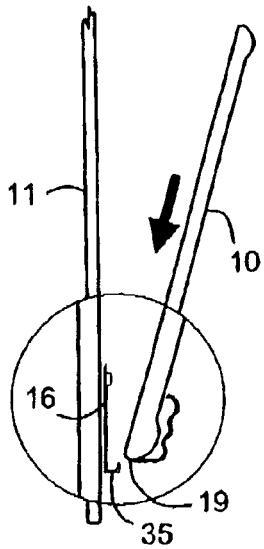
FIG. 6 is a side elevation view showing the mounting of the lower brackets on a wall, with the lower bracket encircled and the frame enlarged.
Figure 7:
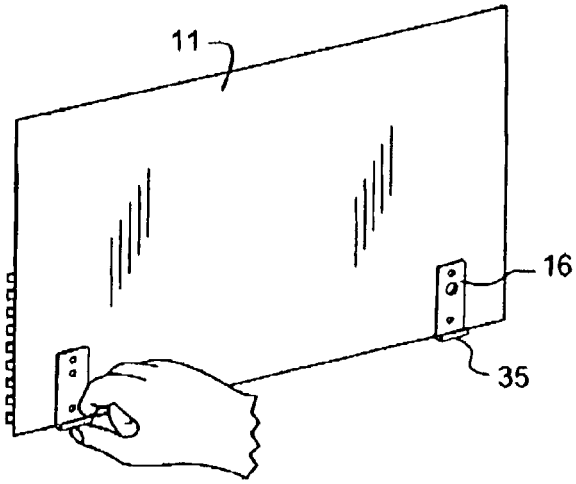
FIG. 7 is a perspective view showing the position of placement of the lower bracket flanges on the wall, with the lower bracket encircled.
Figure 8:
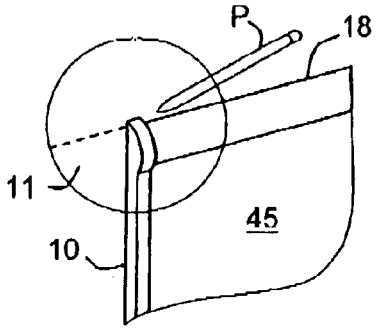
FIG. 8 is an enlarged detail view of the upper left hand corner of the display board shown in FIG. 6 depicting the marking of the position of the upper bracket using the board as a guide when tilted against the wall from the position shown in FIG. 6, with the position marking the location of the upper bracket encircled.

To mount the easel or frame 10 on a wall 11, the intended location of the board on the wall is ascertained, whereupon one of more of the lower brackets 16 is secured to the wall, preferably using wall anchors and screws, fastening the brackets to the wall by using the lower plate mounting holes 33 in the lower bracket plate 31, as shown in FIG. 7, in a position to receive the lower frame edge 19 of the display board or frame. Making sure that the easel frame 10 is level, and then seating it on the lower bracket flange base 34 and hook 35 which engage the lower frame channel 40, in the direction of the arrow shown in FIG. 6. The easel frame is swung against the wall 11, and the location of upper frame edge 19 is marked on the wall with a pencil P or the like, as depicted in FIG. 8, and a level mark is extended similarly to the intended right side of the upper frame edge.

Figure 9:
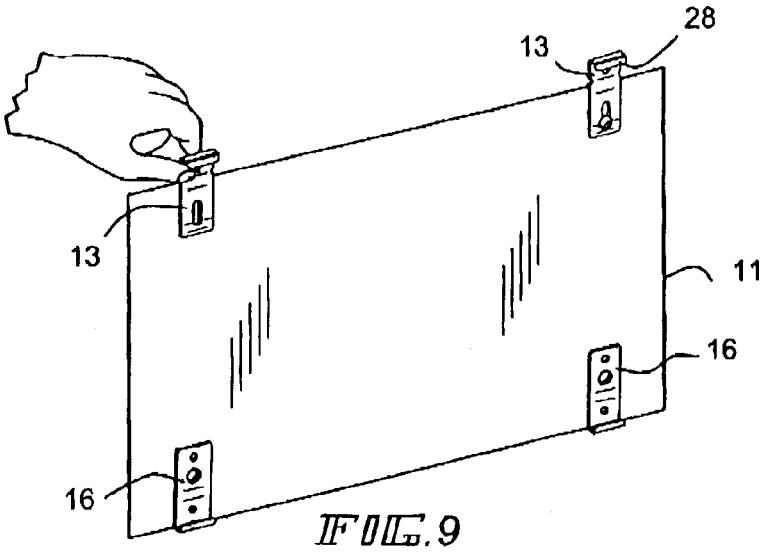
FIG. 9 is a perspective view similar to FIG. 7 showing the positions of placement of the upper and lower brackets onto the wall, with the upper bracket encircled.
Figure 10:
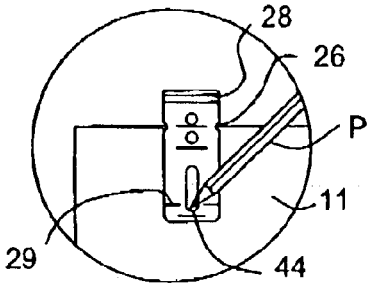
FIG. 10 is an enlarged detail elevation view of the part of the wall intended for receiving the upper left part of the frame, showing the marking and position of an upper bracket on the wall.
Figure 11:
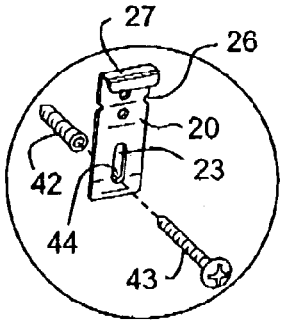
FIG. 11 is an enlarged detail perspective view of the upper bracket shown in FIG. 11 and its mounting screw for the slot on the bracket.

With the intended location of the upper brackets 13 ascertained, these brackets are secured to the wall, as shown in FIGS. 9–11, using the bracket dimples 26 to indicate the location for the upper frame edge 18. With reference to FIG. 10, the position of the bottom of slot 23 on the upper bracket plate 20 is marked with a pencil P or the like, using the arrow indicia 29 marked thereon. An anchor 42 may be installed in the wall 11 and a screw 43 may be threaded therein in the bottom 44 of the slot 23, but this screw should not be overly tightened, to permit the bracket to move in the slot.

Figure 12:
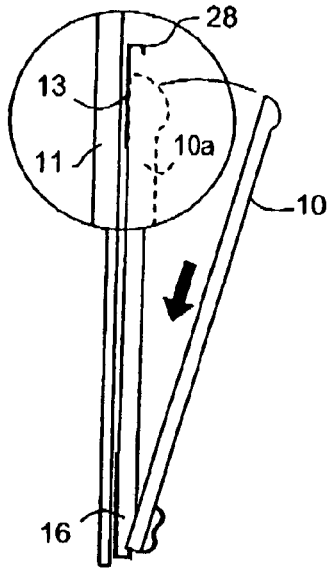
FIG. 12 is a side elevation view similar to FIG. 6, except showing the mounting of the upper and lower brackets on the wall and the placing of the display board on the lower bracket for tilting of the display board against the wall and upper bracket, with the upper bracket encircled and the lighter position of the frame within the circle enlarged.
Figure 13:
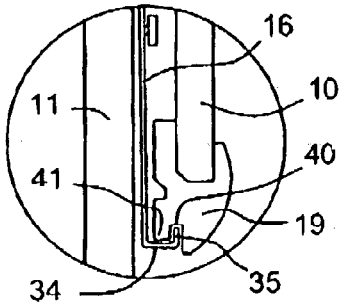
FIG. 13 is a detail sectional view showing the lower portion of the frame mounted on the lower bracket secured against the wall.
Figure 14:
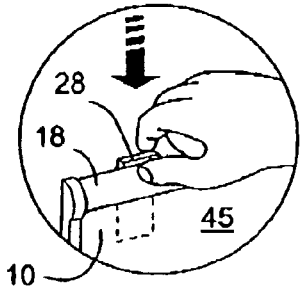
FIG. 14 is an enlarged detail view similar to FIG. 8, except showing the upper bracket partially in broken lines and the sliding of that bracket downwardly onto the frame.
Figure 15:
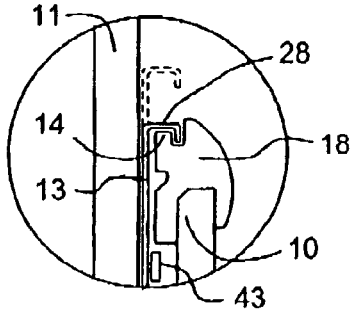
FIG. 15 is a detail sectional view showing the upper portion of the display board and its securement on the upper bracket mounted on the wall, the sliding position of that bracket onto the frame being shown in broken lines.

As illustrated in FIG. 12, with the screw 43 arranged in the bottom 44 of the slot 23, in a position so that the hook 28 and header 27 of the upper bracket 13 is extended upwardly to its full height above the location of the upper edge 18 of the frame and the lower edge 19 of the frame 10 seated as shown in FIG. 13 in its related base 34 and hook 35 of the lower bracket 16 in the direction of the arrow, the frame is tilted toward the light outline of the easel frame 10*a* against the wall 11. The upper bracket 13 is then slid downwardly in the slot 23 in the direction of the arrow of FIG. 14, so that its header 27 and hook 28 seats in the upper frame edge channel 30 of the frame 10, as shown in FIG. 15.

The upper frame edge 18 and the lower frame edge 19 each have a relief cut 14 and 41, respectively, adjacent the wall 11, which permits their respective upper bracket flange and lower bracket flange to be visible from the front 45 of the frame 10 once mounted on the wall. Once installed on the wall 10 in the manner taught by this invention, one may write or hang displays on the front 45 of the display board or frame 10 without concern that the frame will shift on the wall or become dislodged, unless removal is intended.

Removal of the display board or frame 10 from the wall 11 is accomplished by reversing the mounting procedure described, upon sliding the upper bracket 13 upwardly in the slot 23, releasing the frame from the wall.

The hanging of a frame utilizing the novel devices and the method disclosed in this application may be accomplished by placing the respective brackets on any cooperating opposed edges of the item to be hung. In most case, depending upon the size of the easel or frame to be mounted, it is preferable to use two upper brackets 13 and two lower brackets 16, and in the illustration of the preferred embodiments such pairs have been used, but when mounting a small frame of lesser size and weight, only one upper bracket and one lower bracket may have to be used.

While a preferred embodiment of the hanging devices and the method embodying the invention have been shown and described in considerable detail, it is not intended that this invention be limited to the exact structure and steps of the method showed and described, except as limited by the claims.

The invention claimed is:

1. A display board mounting assembly comprising:

a display board assembly having a viewing face and first and second spaced apart edge portions;

a wall on which the display board assembly is hung;

a first bracket mounted to the wall, the first bracket including a flange engaged with the first edge portion; and a second bracket movably mounted to the wall, the second bracket including a flange that is spaced from the second edge portion when in a first mounted position relative to the wall, and that is engaged with the second edge portion when in a second mounted position relative to the wall;

wherein the first and second edge portions define an outside edge of the display board assembly, and wherein the first and second brackets are entirely within the outside edge when the flanges are engaged with the respective first and second edge portions.

2. The display board mounting assembly of claim 1, wherein the first and second brackets are hidden from view when observing the viewing face from a location spaced from and generally aligned with the viewing face in a direction generally normal to the wall.

3. The display board mounting assembly of claim 1, wherein each of the first and second edge portions includes a channel in an outer peripheral surface; and wherein the flange of each of the first and second brackets is received in the channel of the respective first or second edge portions.

4. The display board mounting assembly of claim 3, wherein each flange portion includes a hook portion, the hook portion being received in the channel of the respective first or second edge portion.

5. The display board mounting assembly of claim 3, wherein the display board assembly includes a frame, the frame defining the first and second edge portions.

6. The display board mounting assembly of claim 3, wherein the display board assembly includes a frame, the frame defining the first and second edge portions.

7. The display board mounting assembly of claim 3, wherein the second bracket includes an elongated slot configured to enable movement of the second bracket between the first and second mounted positions relative to the wall.

8. The display board mounting assembly of claim 3, wherein the second bracket includes indicia thereon for facilitating mounting the second bracket to the wall.

9. A method of mounting a display board assembly to a wall, the display board assembly including a viewing face and first and second spaced apart edge portions at least partially defining an outer peripheral surface of the display board assembly, each of the edge portions including a channel formed in the outer peripheral surface, the method comprising:

mounting a first bracket to the wall, the first bracket having a flange;

movably mounting a second bracket to the wall in spaced relation to the first bracket, the second bracket being movable between a first mounted position relative to the wall and a second mounted position relative to the wall;

engaging the display board assembly with the first bracket such that the flange of the first bracket engages the channel in the first edge portion;

positioning the display board assembly such that the channel in the second edge portion is generally aligned with and spaced from the flange of the second bracket when the second bracket is in the first mounted position; and moving the second bracket to the second mounted position such that the flange of the second bracket engages the channel in the second edge portion.

10. The method of claim 9, wherein the first and second edge portions define an outside edge of the display board assembly, and wherein engaging the flanges of the first and second brackets with the respective channels in the first and second edge portions positions the first and second brackets entirely within the outside edge.

11. The method of claim 9, wherein engaging the flanges of the first and second brackets with the respective channels in the first and second edge portions renders the first and second brackets hidden from view when observing the viewing face from a location spaced from and generally aligned with the viewing face in a direction generally normal to the wall.

12. The method of claim 9, wherein the second bracket includes an elongated slot that receives a fastener when movably mounting the second bracket to the wall, and wherein moving the second bracket between the first and second mounted positions includes moving the fastener relative to the elongated slot.

* * * * *

UNITED STATES PATENT AND TRADEMARK OFFICE

CERTIFICATE OF CORRECTION

PATENT NO. : 7,147,196 B2
APPLICATION NO. : 10/409878
DATED : December 12, 2006
INVENTOR(S) : Colin Knight and Tom Dunlap It is certified that error appears in the above-identified patent and that said Letters Patent is hereby corrected as shown below:

Claim 6, column 5, line 52 " claim 3" should be -- claim 1 --.

Claim 7, column 6, line 1 " claim 3" should be -- claim 1 --.

Claim 8, column 6, line 5 " claim 3" should be -- claim 1 --.

Signed and Sealed this

First Day of May, 2007

JON W. DUDAS
*Director of the United States Patent and Trademark Office*